US006981488B2

(12) United States Patent
Harris et al.

(10) Patent No.: US 6,981,488 B2
(45) Date of Patent: Jan. 3, 2006

(54) INTERNAL COMBUSTION ENGINE CYLINDER-TO-CYLINDER BALANCING WITH BALANCED AIR-FUEL RATIOS

(75) Inventors: Ralph E. Harris, San Antonio, TX (US); Gary D. Bourn, San Antonio, TX (US); Anthony J. Smalley, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 10/663,630

(22) Filed: Sep. 16, 2003

(65) Prior Publication Data

US 2005/0056255 A1 Mar. 17, 2005

(51) Int. Cl.
*F02D 41/14* (2006.01)
*F02M 7/00* (2006.01)

(52) U.S. Cl. ..... 123/435; 123/436

(58) Field of Classification Search ..... 123/435, 123/436; 73/116, 117.3; 701/103, 104
See application file for complete search history.

(56) References Cited

U.S. PATENT DOCUMENTS 4,928,653 A * 5/1990 Ohkubo et al. ..... 123/435
4,996,960 A * 3/1991 Nishiyama et al. ..... 123/435
5,474,045 A * 12/1995 Demizu et al. ..... 123/435
5,672,812 A * 9/1997 Meyer ..... 73/35.07
5,765,120 A * 6/1998 Tan et al. ..... 701/103

FOREIGN PATENT DOCUMENTS

JP 60-243336 * 12/1985 ..... 123/676

OTHER PUBLICATIONS

Boutin, Ben, "Combustion Variability in Engines", Dynalco News, http://www.dynalco.com/article.cfm?hid =34, 3 pages, Aug. 29, 2003.
Ely et al., "Engine Balance—The Thinking Has Changed", Anderson Consulting, Training & Testing, 11 pages, no date.
"Gas-Fired Reciprocating Engines", Tech Brief; U.S. Department of Energy, Office of Energy Efficiency and Renewable Energy, 2 pages, no date.
PCT International Search Report and the Written Opinion for International Application No. PCT/US04/29328, 9 pages.

* cited by examiner

*Primary Examiner*—Tony M. Argenbright
(74) *Attorney, Agent, or Firm*—Baker Botts L.L.P.

(57) ABSTRACT

A method of balancing combustion among cylinders of an internal combustion engine. For each cylinder, a normalized peak firing pressure is calculated as the ratio of its peak firing pressure to its combustion pressure. Each cylinder's normalized peak firing pressure is compared to a target value for normalized peak firing pressure. The fuel flow is adjusted to any cylinder whose normalized peak firing pressure is not substantially equal to the target value.

21 Claims, 4 Drawing Sheets

INTERNAL COMBUSTION ENGINE CYLINDER-TO-CYLINDER BALANCING WITH BALANCED AIR-FUEL RATIOS

GOVERNMENT LICENSE RIGHTS

The U.S. Government has a paid-up license in this invention and the right in certain circumstances to require the patent owner to license others on reasonable terms as provided for by the terms of Contract No. DE-FC 26-02NT41646 for the U.S. Department of Energy.

TECHNICAL FIELD OF THE INVENTION

This invention relates to internal combustion engines, and more particularly to balancing combustion of such engines.

BACKGROUND OF THE INVENTION

An internal combustion engine operates best when combustion is balanced among its cylinders. However, a number of factors contribute to cylinder-to-cylinder combustion variations, such as mechanical construction of the engine, engine condition, and combustion controls. To compound the problem, each cylinder can be fueled differently and breathe differently from cycle to cycle.

To help reduce cylinder combustion variation, some engine designers have used fuel balancing valves in the fuel lines upstream of the cylinders' fuel injection valves. These valves are used to adjust the fuel delivery to a given cylinder. Conventionally, adjustments are made until the peak firing pressures of all cylinders are equal.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

As indicated in the Background, this invention relates to the problem of balancing combustion in spark ignited internal combustion engines. The problem is particularly evident in large engines, such as the natural gas engines used for industrial applications. However, the same concepts could be applied to any internal combustion engine having more than one cylinder. The invention is appropriate for any spark ignited engine equipped with sensors capable of measuring pressure in each cylinder and devices to adjust fueling to each cylinder independently.

The combustion balance problem may be stated as follows. The combustion event that occurs in one cylinder tends to differ from the combustion event in the other cylinders, even with averaging over many cycles to eliminate cycle-to-cycle variability. The average air flowing into each cylinder often differs from that for the other cylinders, and the fuel flowing into each cylinder differs from that for the other cylinders.

Figure 1:
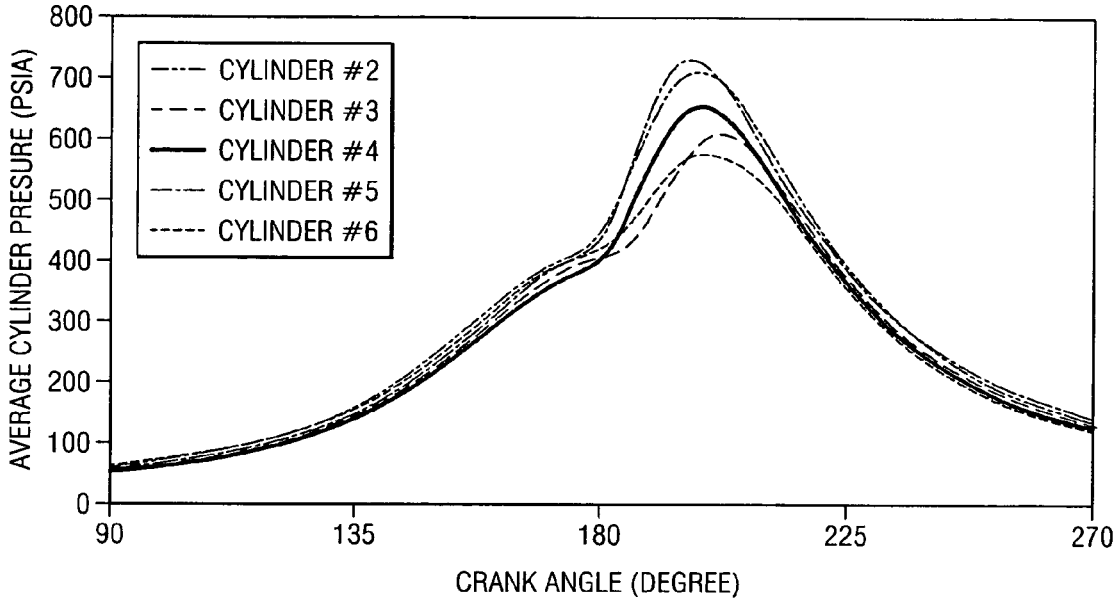
FIG. 1 illustrates measured pressure traces for a six-cylinder engine.

FIG. 1 illustrates measured pressure traces from a six cylinder engine. Pressure measures are made, using appropriate sensors, within each engine cylinder. Each cylinder's cycle is represented by one pressure trace. More specifically, each trace represents average cylinder pressure over 50 cycles, and each is plotted against crank angle, referred to the cylinder's bottom dead center (BDC), that is, the instant at which the piston reaches the point in its travel closest to the crankshaft.

The traces of FIG. 1 show differences in the buildup of pressure between 0 degrees and 180 degrees of crank rotation (pre-ignition) and further differences in the buildup of pressure after ignition to the point of maximum pressure (peak firing pressure).

For a two-stroke engine, the pre-ignition pressure buildup follows the inducing of air through the ports and trapping and compressing a mass of air in the cylinder after the ports close. The differences result from uncontrolled air flow dynamics in air and exhaust manifolds, which strongly influence cylinder air flows. At some point after the ports close, fuel is injected into the cylinder. If, at some finite angle prior to top dead center (TDC), the pressures differ, this implies a difference in the mass of air and fuel trapped in the cylinder.

As a result of combustion imbalance, without corrective action, six different pressure traces occur, implying six different combustion events, some richer than others, some leaner than others. In FIG. 1, the pressures in different cylinders at 20 degrees before TDC (160 degrees) vary by close to 10% of the average pressure, implying a 10% difference in trapped air mass. If the pressure traces cross each other after ignition, as in FIG. 1, this indicates that the air-fuel ratio, as well as the trapped air mass, differs among cylinders.

Figure 2:
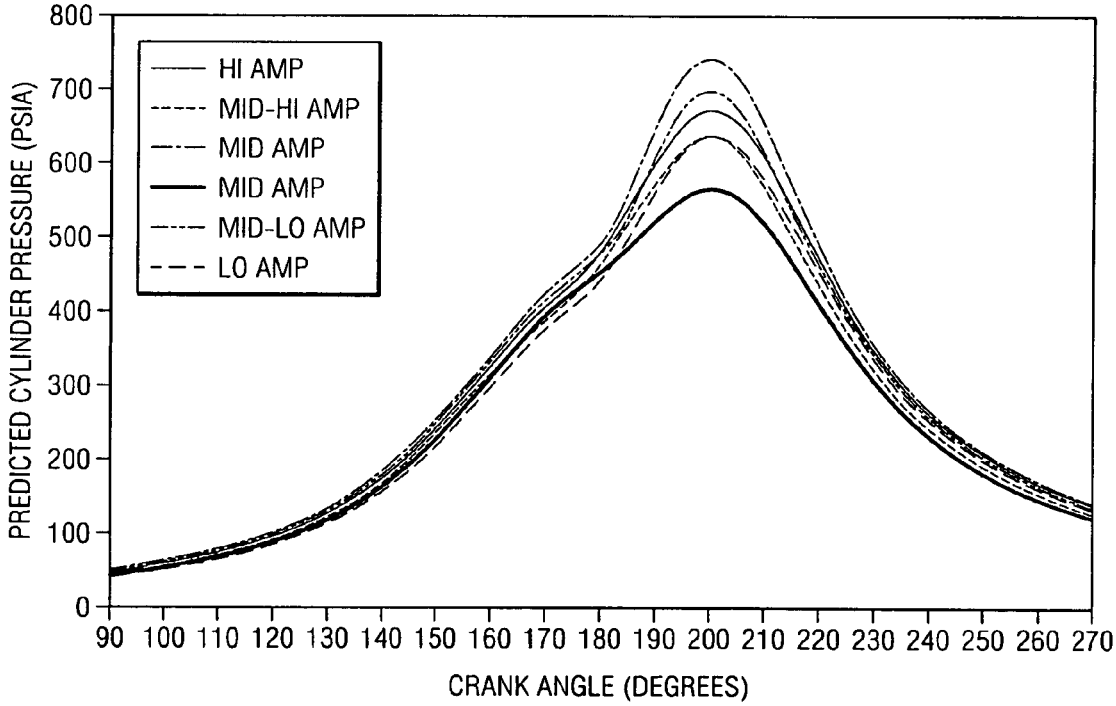
FIG. 2 illustrates simulated pressure traces for a virtual six-cylinder engine.
Figure 3:
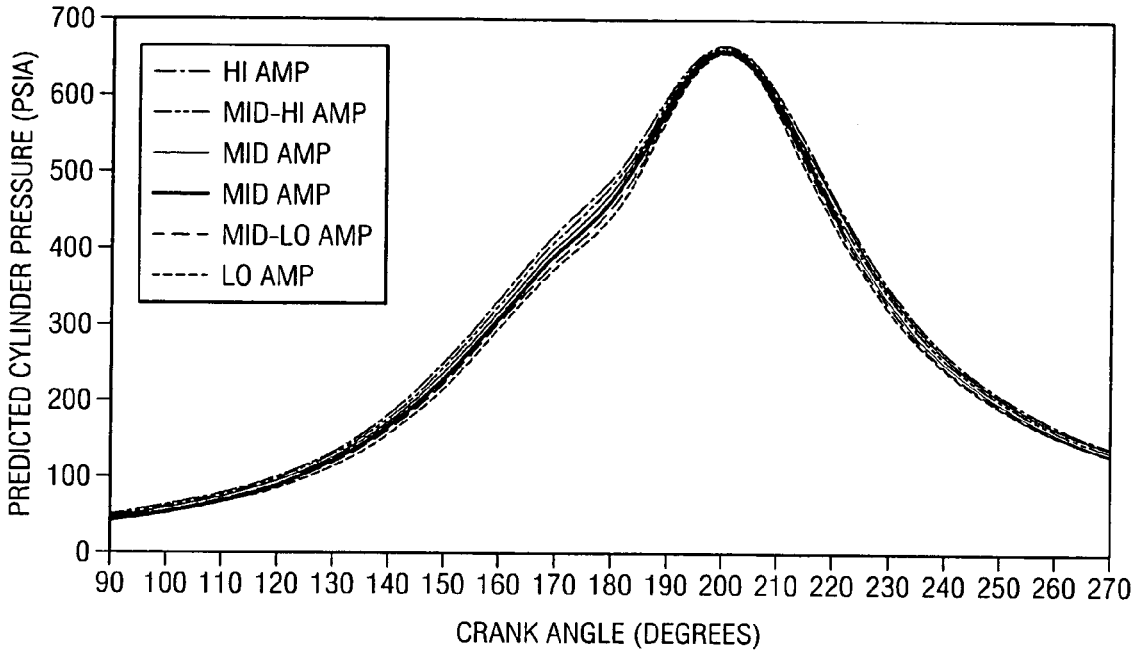
FIG. 3 illustrates simulated pressure traces where fuel flow has been adjusted to achieve equal peak firing pressures for all cylinders.
Figure 4:
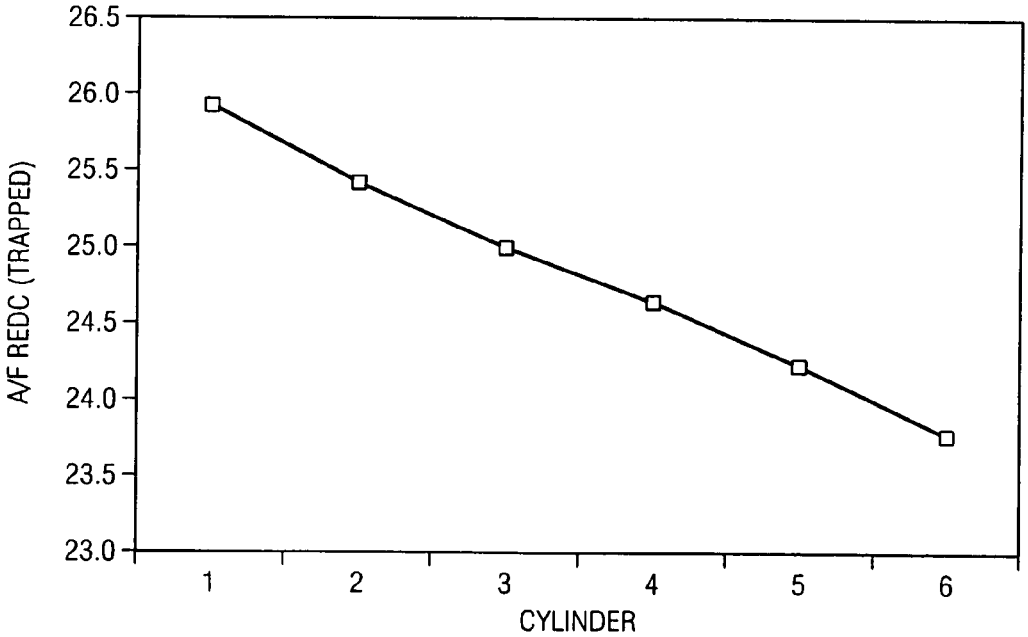
FIG. 4 illustrates air-fuel ratios for the cylinders of FIG. 3.

FIG. 2 illustrates simulated pressure traces for a virtual engine, which exhibits imbalance characteristics similar to those of FIG. 1. FIG. 3 illustrates the simulated results of using conventional balancing methods for the virtual engine modeled in FIG. 2. The fuel valves have been adjusted for individual cylinders until the peak firing pressures (PFPs) are close to equal. FIG. 4 illustrates the air-fuel ratios needed for each cylinder, to obtain the equal PFP values of FIG. 3. These differ by 10% between higher and lowest, which is a significant difference.

FIGS. 2–4 illustrate, by using engine simulations, that achieving PFP balancing does not truly balance combustion. That is, the cylinders receive different air-fuel ratios, and although engine performance may be better than without PFP balancing, the engine performance and exhaust emissions are not optimal.

Figure 5:
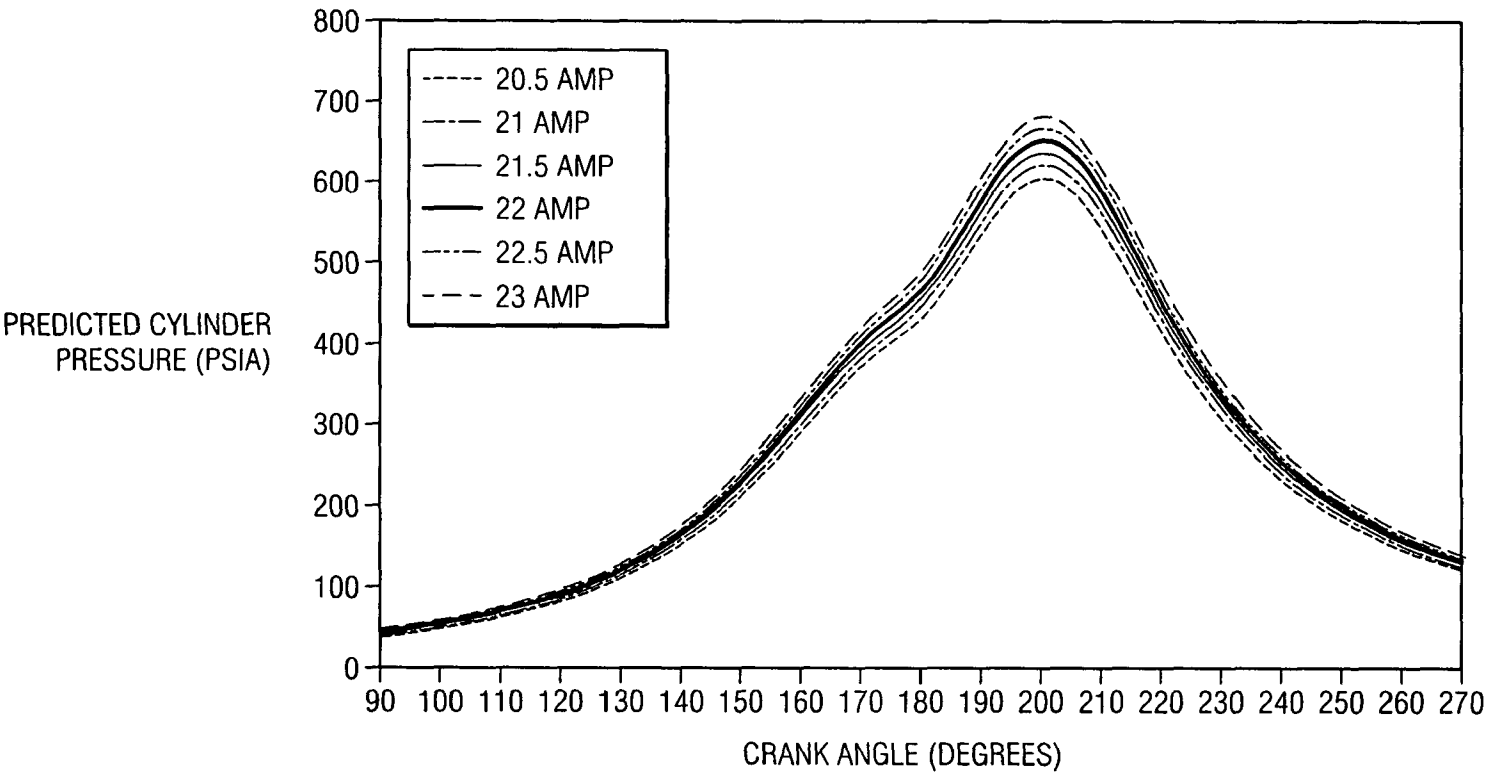
FIG. 5 illustrates the pressure traces for a simulated six-cylinder engine having equal air-fuel ratios for each cylinder and the cylinders also having varying air manifold pressures.

FIG. 5 illustrates the performance of a simulated engine, specifically, pressure traces with the same air-fuel ratio in each cylinder, but with varying air manifold pressures (AMPs). Each pressure trace has a similar shape. In fact, each trace satisfies a common value for the ratio of PFP to compression pressure (CP), wherever chosen before ignition occurs.

Implicitly, FIG. 5 illustrates the results of combustion balancing in accordance with the present invention. The target is to achieve equal air-fuel ratios for each cylinder. In other words, for each cylinder, fuel is added in an amount appropriate to that cylinder's air mass. As explained below, rather than attempt to measure the trapped air-fuel ratio, a surrogate indicator is used.

Thus, in accordance with the present invention, balanced combustion is achieved by adjusting the fuel flow for each cylinder up or down in order to minimize the differences across cylinders in normalized peak pressure. "Normalized peak pressure" is defined as the peak firing pressure (PFP) for the cylinder divided by the compression pressure (CP) for the cylinder.

Figure 6:
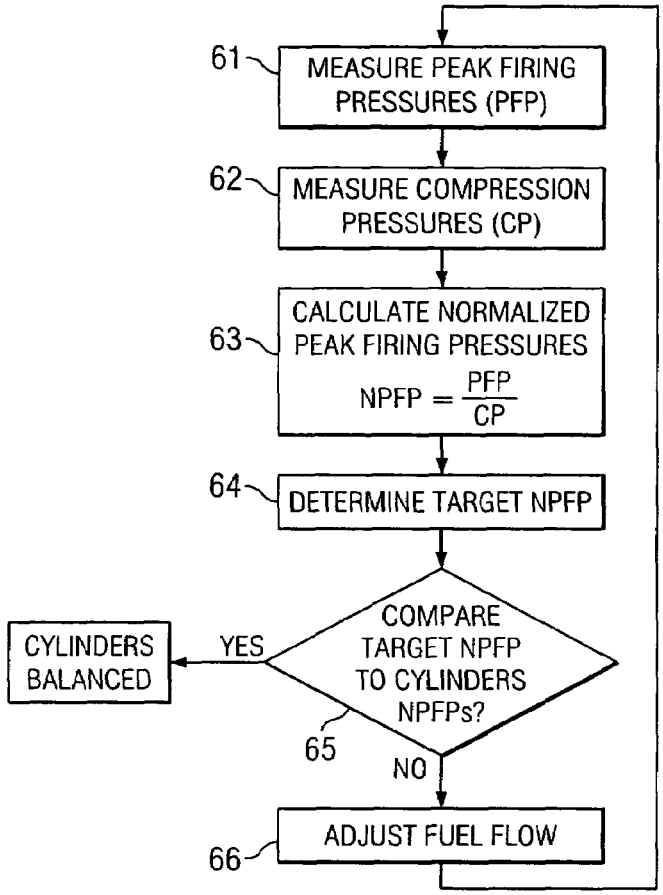
FIG. 6 illustrates a method of cylinder-to-cylinder balancing in accordance with the invention.

FIG. 6 illustrates a method of cylinder-to-cylinder balancing in accordance with the invention. The method is iterative in the sense that measurements and adjustments are repeated over time until balance is achieved. Measurements can then continue or be repeated after some period of time, to ensure that the balanced combustion continues throughout engine operation.

Step 61 is measuring the peak firing pressure (PFP) for each cylinder. Step 61 may be performed by capturing a pressure trace for each cylinder, similar to the traces of FIGS. 1 and 2. For each cylinder, its pressure trace typically represents an average of some number of cycles, such as 50 cycles, although the method could be used with a trace for a single cycle.

Step 62 is measuring the compression pressure (CP) for each cylinder. For example, the pressure at 20 degrees before TDC may be used. Any value shortly before ignition should be suitable. Like Step 61, Step 62 may be performed by averaging data over a number of cycles.

Step 63 is calculating the normalized peak firing pressure (NPFP) for each cylinder, where:

$$NPFP=PFP/CP$$

The value for NPFP may be calculated for values of PFP and CP from a trace that has been averaged over multiple cycles or from a trace from a single cycle. The resulting value for NPFP may be further averaged over multiple cycles or multiple groups of cycles. Both a ratio of averages or an average of ratios could be used.

Step 64 is determining a target NPFP for the engine. This "target" value is the NPFP value to which all cylinders will be adjusted. An example of a target NPFP value is the mean value of the NPFP values of all cylinders. Alternatively, a target NPFP may be specified for the engine or otherwise determined.

Step 65 is comparing the NPFP for each cylinder to the mean NPFP obtained in Step 64. If a cylinder's NPFP is equal to the target value, that cylinder is not adjusted.

Step 66 is adjusting the fuel flow into cylinders whose NPFP does not match the target NPFP value. The adjustment is based on the difference between that cylinder's NPFP and the mean NPFP. Cylinders whose ratio is below the mean are normally adjusted up, and cylinders whose ratio is above the mean are normally adjusted down. The "normally" qualification anticipates the possibility of an intelligent control algorithm that anticipates subsequent adjustments in an iterative process. A cutoff may be made for very small adjustments, and for iterative balancing, the amount of the adjustments may be limited to avoid large variations in engine operation. Steps 61–66 are repeated until an acceptable balance of NPFP values is obtained among the cylinders.

The adjustment of Step 66 could be manual for engines not having means for automated fuel control. In other engines, the adjustments could be made automatically, such as by using electronically control fuel adjustment valves or injectors.

Figure 7:
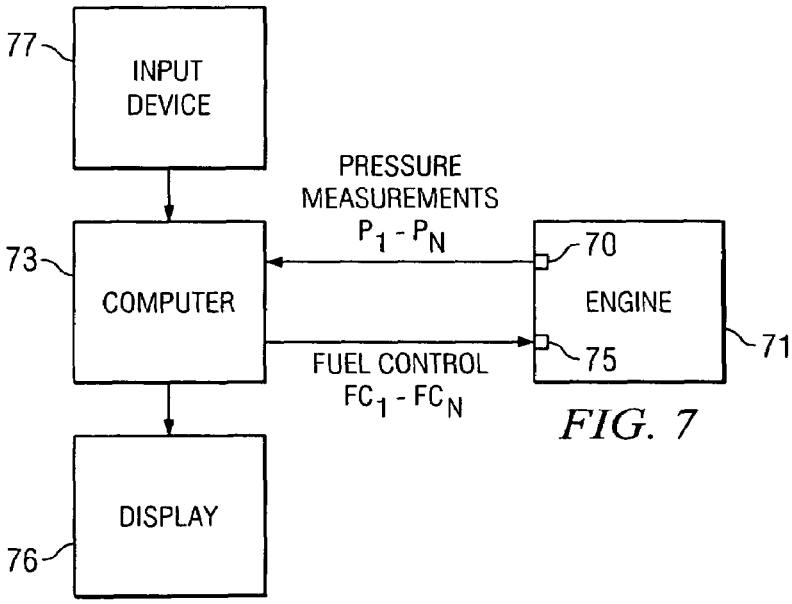
FIG. 7 illustrates how the method of FIG. 6 may be implemented using an interactive computer interface.

FIG. 7 illustrates how the method of FIG. 6 may be implemented using an interactive computer interface. The method of FIG. 7 is appropriate as a diagnostic tool, used for engines, such as large natural gas engines. As explained below, FIG. 7 illustrates an engine having automated fuel control, but the fuel adjustments could also be done manually.

Appropriate pressure sensors 70, one for each cylinder of engine 71, are used to obtain pressure measurements. The pressure data may be stored as a set of pressure trace data for each cylinder, similar to the plotted data of FIGS. 1 and 2.

Computer 73 receives the pressure measurements. It stores a set of measurements from each pressure sensor, P1–Pn.

Computer 73 is programmed to execute Steps 61–66. Once a fuel adjustment is calculated for a cylinder, an operator may manually adjust the amount of fuel delivered to the cylinder. Alternatively, a fuel control signal, FC1–FCn, may be sent to engine 71 to control the fuel injector 75 for the cylinder.

A display 76 may used to provide pressure trace displays similar to those of FIGS. 1 and 2. The traces may be used to display the PFP and CP values for the cylinders. After the calculations of Step 65, display 76 may be used to display the suggested fuel adjustment, in terms of percentage or otherwise, for each cylinder. Pressure trace displays may be displayed for each iteration.

The system of FIG. 7 is easily modified for embedded controller applications, rather than interactive applications. All measurements, calculations, and adjustments would then be made automatically and invisibly to the engine operator, such as in the case of the driver of an automobile. The computer would be replaced by a controller or other processor based equipment, whose functions could be integrated with other engine control operations and performed by the engine control unit.

What is claimed is:

1. A method of calculating fuel flow adjustments for balancing combustion among cylinders of an internal combustion engine, comprising the steps of:

measuring the peak firing pressure within each cylinder;

measuring the compression pressure within each cylinder;

for each cylinder, calculating its associated normalized peak firing pressure (NPFP) as the ratio of its peak firing pressure to its compression pressure;

determining a balancing NPFP, the balancing NPFP being between the smallest calculated NPFP and the largest calculated NPFP, thereby determining a target NPFP for the engine;

comparing the target NPFP to the NPFP for each cylinder; and calculating a fuel flow adjustment to any cylinder whose NPFP is not substantially equal to the target NPFP.

2. The method of claim 1, wherein the step of measuring peak firing pressure is performed by measuring peak firing pressures for a number of cycles and averaging over those cycles.

3. The method of claim 1, wherein the step of measuring compression pressure is performed by measuring combustion pressures for a number of cycles and averaging over those cycles.

4. The method of claim 1, wherein the step of calculating each cylinder's NPFP is performed by calculating an average of ratios of its peak firing pressure to its compression pressure.

5. The method of claim 1, wherein the target NPFP is the mean of the NPFP values calculated in the calculating step.

6. The method of claim 1, wherein the determining, comparing, and calculating steps are performed by a computer, and further comprising the step of displaying the results of the measuring steps on a computer display.

7. The method of claim 1, wherein the determining, comparing, and calculating steps are performed by a computer, and further comprising the step of displaying the results of at least one of these steps on a computer display.

8. The method of claim 1, wherein the compression pressure is measured at a crank angle of approximately 160 degrees.

9. A method of balancing combustion among cylinders of an internal combustion engine, comprising the steps of:

measuring the peak firing pressure within each cylinder;

measuring the compression pressure within each cylinder;

for each cylinder, calculating its associated normalized peak firing pressure (NPFP) as the ratio of its peak firing pressure to its compression pressure;

determining a balancing NPFP, the balancing NPFP being between the smallest calculated NPFP and the largest calculated NPFP, thereby determining a target NPFP for the engine;

comparing the target NPFP to the NPFP for each cylinder; and calculating a fuel flow adjustment to any cylinder whose NPFP is not substantially equal to the target NPFP; and adjusting the fuel flow in accordance with the calculating step.

10. The method of claim 9, wherein the method is performed automatically by an embedded engine control unit.

11. The method of claim 9, wherein the method is performed automatically by a computer system in electronic communication with fuel control valves or injectors.

12. The method of claim 9, wherein the adjusting step is limited and further comprising the step of repeating the measuring, calculating, comparing, and adjusting steps until the NPFP of each cylinder is substantially equal to the target NPFP.

13. An interactive computer system for balancing combustion among cylinders of an internal combustion engine, each cylinder having an associated pressure sensor, comprising:

a processing system for receiving pressure measurements from the pressure sensors; for determining the peak firing pressure and the compression pressure within each cylinder; for calculating each cylinder's associated normalized peak firing pressure (NPFP) as the ratio of its peak firing pressure to its compression pressure; for determining a balancing NPFP, the balancing NPFP being between the smallest calculated NPFP and the largest calculated NPFP, thereby determining a target NPFP for the engine; for comparing the target NPFP to the NPFP for each cylinder; and for calculating fuel control adjustment values based on the comparing step;

a computer display for displaying the fuel control adjustment values.

14. The system of claim 13, wherein the display further displays pressure measurement values.

15. An automated combustion balancing system for balancing combustion among cylinders of an internal combustion engine, each cylinder having a pre-combustion fuel control valve, comprising:

a pressure sensor associated with each cylinder for measuring the peak firing pressure and the compression pressure within each cylinder; and a processing system for calculating each cylinder's associated normalized peak firing pressure (NPFP) as the ratio of its peak firing pressure to its compression pressure; determining a balancing NPFP, the balancing NPFP being between the smallest calculated NPFP and the largest calculated NPFP, thereby determining a target NPFP for the engine; comparing the target NPFP to the NPFP for each cylinder; and providing a control signal to the fuel flow valve to each cylinder, such that the fuel flow to any cylinder whose NPFP is not substantially equal to the target NPFP is adjusted; and fuel control valves associated with each cylinder.

16. The system of claim 15, wherein the processing system is part of an engine control unit.

17. The method of claim 1, wherein the step of determining a balancing NPFP is performed such that it represents a condition in which the air-fuel ratio among the cylinders is equalized.

18. The method of claim 1, wherein the calculating step is based on an averaging technique of the cylinders'NPFP values.

19. The system of claim 13, wherein the target NPFP is the mean of the NPFP values calculated in the calculating step.

20. The method of claim 9, wherein the step of determining a balancing NPFP is performed such that it represents a condition in which the air-fuel ratio among the cylinders is equalized.

21. The method of claim 9, wherein the calculating step is based on an averaging technique of the cylinders'NPFP values.

* * * * *